US008808119B1

(12) United States Patent
Dubuisson

(10) Patent No.: US 8,808,119 B1
(45) Date of Patent: Aug. 19, 2014

(54) BOWL-SHAPED RECEPTACLE AND BALL-BASED GAME FOR USE THERE WITH

(76) Inventor: Jodis Dubuisson, Randolph, MA (US)

( * ) Notice: Subject to any disclaimer, the term of this patent is extended or adjusted under 35 U.S.C. 154(b) by 210 days.

(21) Appl. No.: 13/466,331

(22) Filed: May 8, 2012

(51) Int. Cl.
*A63B 59/02* (2006.01)
*A63B 65/12* (2006.01)

(52) U.S. Cl.
CPC ..... *A63B 59/02* (2013.01)
USPC ..... 473/505

(58) Field of Classification Search
USPC ..... 473/505, 510, 511, 513, 514, 573; 210/464; 273/108, 110, 116, 386, 273/348.4; D21/790
See application file for complete search history.

(56) References Cited

U.S. PATENT DOCUMENTS 1,063,119 A * 5/1913 Clifford ..... 473/196
2,201,802 A * 5/1940 Steiner ..... 473/511
3,467,381 A * 9/1969 Kreiss ..... 473/511
3,617,061 A * 11/1971 Goldfarb et al. ..... 273/110
3,953,030 A * 4/1976 Muchnick ..... 273/348.4
4,017,076 A * 4/1977 Bai ..... 273/348.4
4,266,778 A * 5/1981 Sine ..... 473/510
4,360,206 A * 11/1982 Bian ..... 273/348.2
4,537,402 A * 8/1985 Prather, Jr. ..... 273/116
5,209,490 A * 5/1993 Dallavecchia ..... 273/348.4
5,351,968 A * 10/1994 Starnes ..... 273/348.4
D352,968 S * 11/1994 Yu ..... D21/790
5,501,441 A * 3/1996 Kegley ..... 269/289 R
D394,340 S * 5/1998 Kennard ..... D2/869
6,604,742 B2 * 8/2003 El Sabbagh ..... 273/348.4
2011/0130229 A1 * 6/2011 Williams ..... 473/505

* cited by examiner

*Primary Examiner* — Gene Kim
*Assistant Examiner* — M Chambers

(57) ABSTRACT

The bowl-shaped receptacle and ball-based game for use there with includes the bowl-based receptacle being comprised of an annular ring member that encircles a bowl appendage. The bowl appendage consists of a concaved ring having a plurality of fingers that extend inwardly as well as downwardly forming a central opening. A ball landing into the bowl appendage is engaged by the fingers around a circumference, and temporarily holds the ball thereon, until subsequently hurled back towards an opposing player. The annular ring member includes diametrically opposed handles along a bottom surface, which are grabbed via hands of a player. The player shall hold the bowl-shaped receptacle with arms in a fully or partially extended manner, and shall catch and bounce back a ball upon a cradling action and consequential flinging action defined by lowering and raising movement of the arms in concert.

7 Claims, 4 Drawing Sheets

BOWL-SHAPED RECEPTACLE AND BALL-BASED GAME FOR USE THERE WITH

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

A. Field of the Invention

The present invention relates to the field of fully extended arm(s) tossed games, more specifically, a bowl-shaped receptacle that is used to catch and toss a ball.

Recreational ball-based games have been around for centuries. Moreover, different ball-based games require interaction with different body parts of the players. A game like Volleyball, for instance, requires a player to react with a ball in an extended arm manner whereby the forearm(s) of the player interact with the ball to bounce and return the volleyball to either an adjacent player or over the net for the receiving team to respond.

To date, there is no ball-based game wherein each player is provided a bowl-based receptacle that is used to simultaneously catch and hurl back a ball whereby the bowl-based receptacle is engaged via hands of the respective player from underneath.

The device of the present application offers a bowl-based receptacle and an applicable game for use there with whereby each player simulates movement of arms consistent with playing volleyball, and whereby a bowl-shaped receptacle that is grabbed from underneath shall react with a respective ball to exchange the ball between all applicable players.

B. Discussion of the Prior Art

As will be discussed immediately below, no prior art discloses a bowl-based receptacle that includes an annular ring member that encircles a bowl appendage; wherein the bowl 11 appendage is constructed of a concaved ring having a plurality of fingers extending downwardly as well as inwardly; wherein the bowl appendage extends downwardly from the annular ring; wherein the plurality of fingers of the bowl appendage leave a central opening, such that a ball is engaged around a circumference via the fingers, which prevent the ball from falling through the central opening of the bowl appendage; wherein the annular ring member includes diametrically opposed handles along a bottom surface, which are grabbed via hands of a player such that the annular ring member and the bowl appendage are provided above and between hands of said player; wherein the handles are formed of notches made into a bottom surface of the annular ring, which are grabbed via the fingers of the player holding the bowl-based receptacle; whereby said player holds the bowl-shaped receptacle catch and bounce back a ball upon a cradling action and consequential flinging action defined by lowering and raising movement of the arms in concert.

The Bian Patent (U.S. Pat. No. 4,360,206) discloses a game involving a ball and hand held ball catching targets. However, the targets do not resemble a two-handled bowl-shaped receptacle that is grabbed from underneath by hands of a player, and which is used with both arms in a fully extended manner.

The Bai Patent (U.S. Pat. No. 4,017,076) discloses a hand held target and ball game in which the ball is bounced or thrown between players and points are scored depending on where the ball hits the target. Again, the hand held target is grabbed via a single hand, and not held via both hands while the arms are in a fully or partially extended manner.

The Muchnick Patent (U.S. Pat. No. 3,953,030) discloses a throw and catch game in which a ball is thrown between two players and the ball will stick to the glove or hand held target. Again, the glove or hand held target is engaged upon via a single hand, and not held between two hands while the arms are fully or partially extended.

The Dallavecchia Patent (U.S. Pat. No. 5,209,490) discloses a hand device for catching a ball in which the ball enters the glove and can then be removed and thrown back. Again, the glove is affixed to a single hand, and does not require partial or full extension of the arms for use in catching and returning of a game ball.

The El Sabbagh Patent (U.S. Pat. No. 6,604,742) discloses a game in which the object is to catch and throw a ball between two players. Again, the ball or disc caught and thrown via use of a single hand and respective arm, and not via both arms in concert therein.

While the above-described devices fulfill their respective and particular objects and requirements, they do not describe a bowl-based receptacle that includes an annular ring member that encircles a bowl appendage; wherein the bowl appendage is constructed of a concaved ring having a plurality of fingers extending downwardly as well as inwardly; wherein the bowl appendage extends downwardly from the annular ring; wherein the plurality of fingers of the bowl appendage leave a central opening, such that a ball is engaged around a circumference via the fingers, which prevent the ball from falling through the central opening of the bowl appendage; wherein the annular ring member includes diametrically opposed handles along a bottom surface, which are grabbed via hands of a player such that the annular ring member and the bowl appendage are provided above and between hands of said player; wherein the handles are formed of notches made into a bottom surface of the annular ring, which are grabbed via the fingers of the player holding the bowl-based receptacle; whereby said player holds the bowl-shaped receptacle with arms in a fully or partially extended manner, and shall catch and bounce back a ball upon a cradling action and consequential flinging action defined by lowering and raising movement of the arms in concert. In this regard, the bowl-shaped receptacle and ball-based game for use there with departs from the conventional concepts and designs of the prior art.

SUMMARY OF THE INVENTION

The bowl-shaped receptacle and ball-based game for use there with includes the bowl-based receptacle being comprised of an annular ring member that encircles a bowl appendage. The bowl appendage consists of a concaved ring having a plurality of fingers that extend inwardly as well as downwardly forming a central opening. A ball landing into the bowl appendage is engaged by the fingers around a circumference, and temporarily holds the ball thereon, until subsequently hurled back towards an opposing player. The annular ring member includes diametrically opposed handles along a bottom surface, which are grabbed via hands of a player such that the annular ring member and the bowl appendage are provided above and between hands of said player. The player shall hold the bowl-shaped receptacle with arms in a fully or partially extended manner, and shall catch and bounce back a ball upon a cradling action and consequential flinging action defined by lowering and raising movement of the arms in concert.

It is an object of the invention to provide a bowl-shaped receptacle and ball used to play a game between two or more players whereby each player catches and bounces back said ball with both arms moving in concert in a partial or full extension of said arms.

A further object of the invention is to provide a bowl-shaped receptacle that includes an annular ring member that connects to a bowl appendage consisting of a concave disc having a plurality of fingers that extend downwardly and inwardly.

An even further object of the invention is to enable the bowl-shaped receptacle to interact with the ball along a top surface of either the annular ring member or with the fingers of the bowl appendage.

Another object of the bowl-shaped receptacle is to provide a plurality of fingers that are flexible, and which enables the ball to be caught and subsequently hurled back.

A further object of the invention is to provide a pair of handles that are diametrically opposite of one another along a bottom surface of the annular ring member, and which are composed of notches grabbed by fingertips and hands of the end user while corresponding arms are fully or partially extended.

Another object of the invention is to grab the bowl-shaped receptacle and simulate arm movement consistent with playing volleyball, but with the ball impacting the bowl-shaped receptacle located between and above the hands.

These together with additional objects, features and advantages of the bowl-shaped receptacle and ball-based game for use there with will be readily apparent to those of ordinary skill in the art upon reading the following detailed description of presently preferred, but nonetheless illustrative, embodiments of the bowl-shaped receptacle and ball-based game for use there with when taken in conjunction with the accompanying drawings.

In this respect, before explaining the current embodiments of the bowl-shaped receptacle and ball-based game for use there with in detail, it is to be understood that the bowl-shaped receptacle and ball-based game for use there with is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bowl-shaped receptacle and ball-based game for use there with.

It is therefore important that the claims be regarded as including such equivalent construction insofar as they do not depart from the spirit and scope of the bowl-shaped receptacle and ball-based game for use there with. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 6 illustrates a close up detail of an end user grabbing hold of the handles of the bowl-shaped receptacle while the ball is caught and hurled there from.

DETAILED DESCRIPTION OF THE EMBODIMENT

Figure 1:
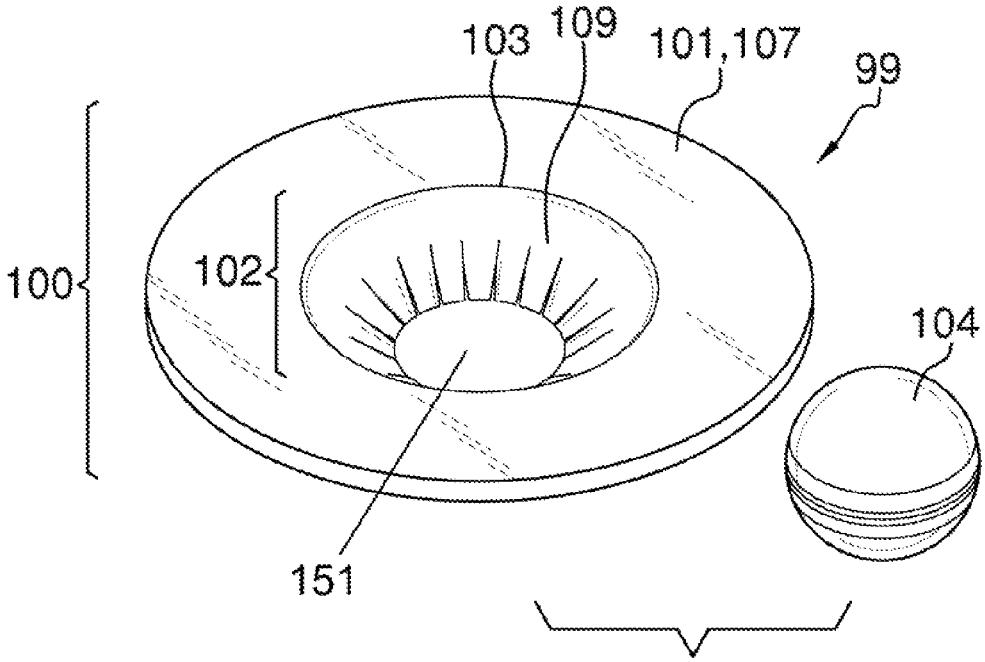
FIG. 1 illustrates a perspective view of the bowl-shaped receptacle and ball.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A bowl-shaped receptacle and ball-based game for use there with 99 (hereinafter invention) includes a bowl-shaped receptacle 100 comprised of an annular ring member 101 and a bowl appendage 102. The bowl appendage 102 attaches to an inner ring 103 of the annular ring member 101. The bowl appendage 102 extends downwardly from the inner ring 103, and produces a trapping effect when engaged with a ball 104.

Figure 2:
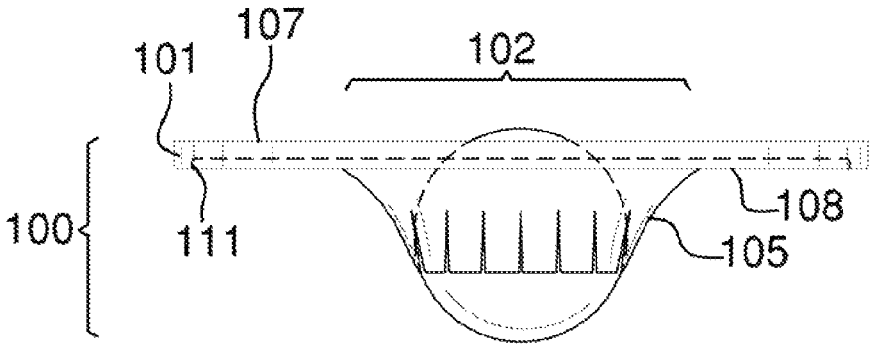
FIG. 2 illustrates a side view of the bowl-shaped receptacle.
Figure 3:
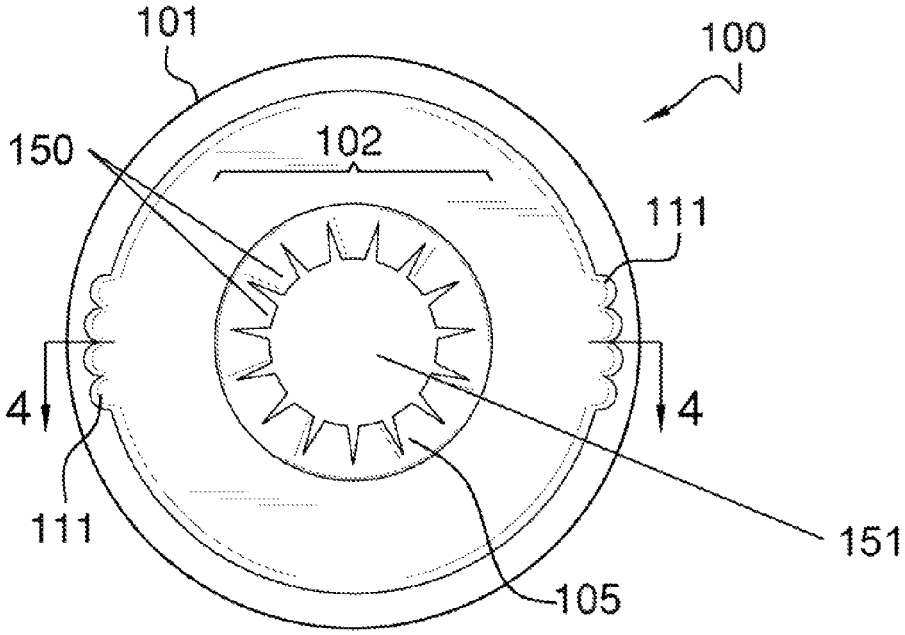
FIG. 3 illustrates a bottom view of the bowl-shaped receptacle further detailing the location of the handles as notches integrated into the bottom surface of the annular ring as well as the fingers extending downwardly from the concave disc forming the bowl appendage.

The bowl appendage 102 is further defined as a concave ring 105 that extends inwardly as well as downwardly with respect to the ring member 101. Moreover, the concave ring 105 includes a plurality of equally spaced fingers 150 that too extend inwardly and downwardly in order to form a central opening 151. Referring to FIG. 2 it shall be noted that the fingers 150 are made of a flexible material, and are rotated outwardly when the ball 104 is trapped or caught therein. The fingers and thus the concave ring 105 shall be made of a material comprising plastic, wood, carbon fiber composite, or metal. The fingers 150 form the central opening 151, which has a diameter less than that of the ball 104.

The annular ring member 101 is further defined by a top surface 107 and a bottom surface 108. The concave ring 105 is further defined with an inner surface 109, which engages the ball 104 when trapped or caught therein. The annular ring member 101 is constructed of a lightweight yet rigid material comprising of a plastic, wood, carbon fiber composite, or metal.

The invention 100 includes a pair of handles 111 that are integrated into the bottom surface 108 of the annular ring member 101. Moreover, the handles 111 are diametrically opposed from one another, and are grooves notched out from the bottom surface 108 of the annular ring member 101. The handles 111 are grabbed via opposing hands 131 of an end user 130. It shall be noted that the bottom surface 108 and handles 111 of the annular ring member 101 form a lipped edge 112, which aids in grabbing via the end user 130. The lipped edge 112 forms a shape to the annular ring member 101, which is analogous of a Frisbee throwing disc.

Figure 6:
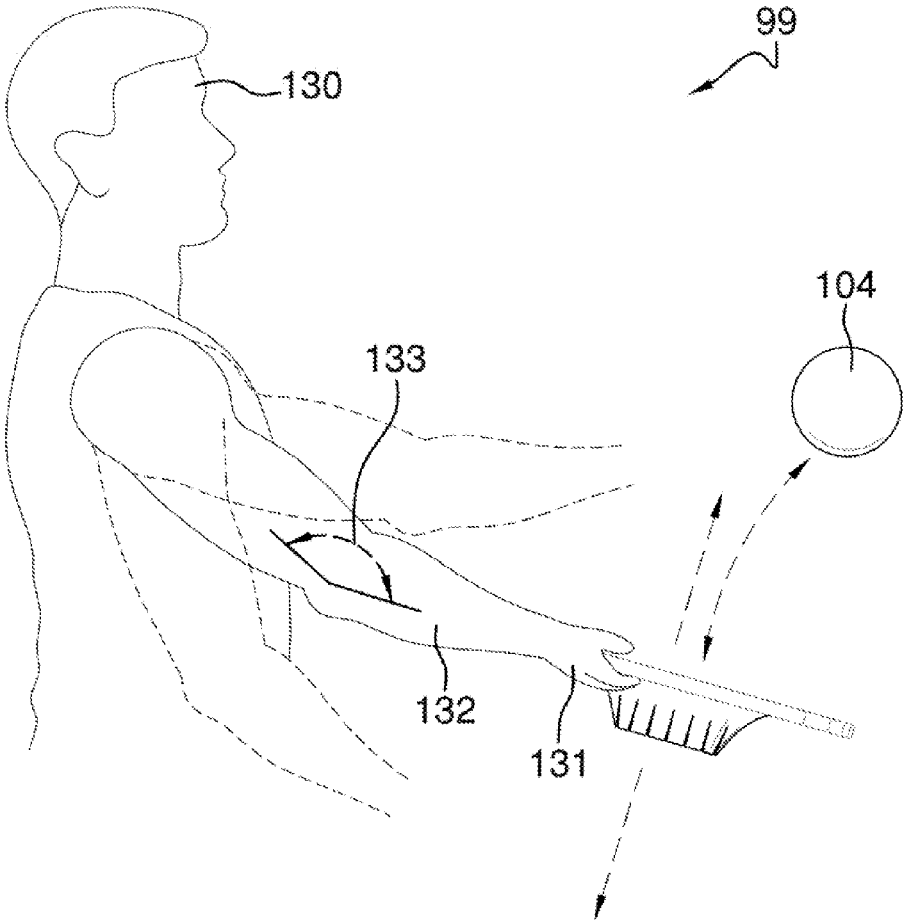

In referring to FIG. 6, the end user 130 shall have both arms 132 either fully or partially extended, and in concert with one another. It shall be further clarified that the term concert with one another signifies that both arms 132 mirror one another and move in the same fashion where downwardly or upwardly. It shall be further noted that the arms 132 form a partial angle 133 when partially extended.

Figure 4:
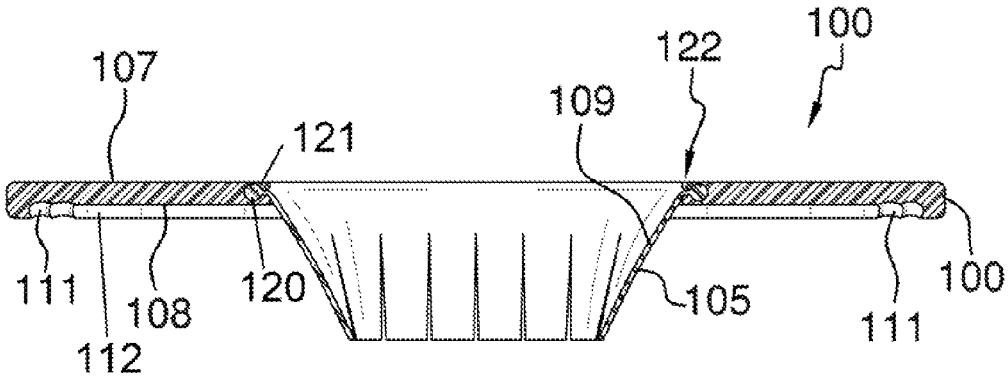
FIG. 4 illustrates a cross-sectional view of the bowl-shaped receptacle along line 4-4 in FIG. 3, and further detailing the construction of the annular ring member, bowl appendage, and handles.

Referring to FIG. 4, the concave ring 105 includes a grooved lip 120 along a top periphery 122, which attach to a contoured notch 121 provided at the inner ring 103 of the annular ring member 101 thereby securing all applicable parts together.

Figure 5:
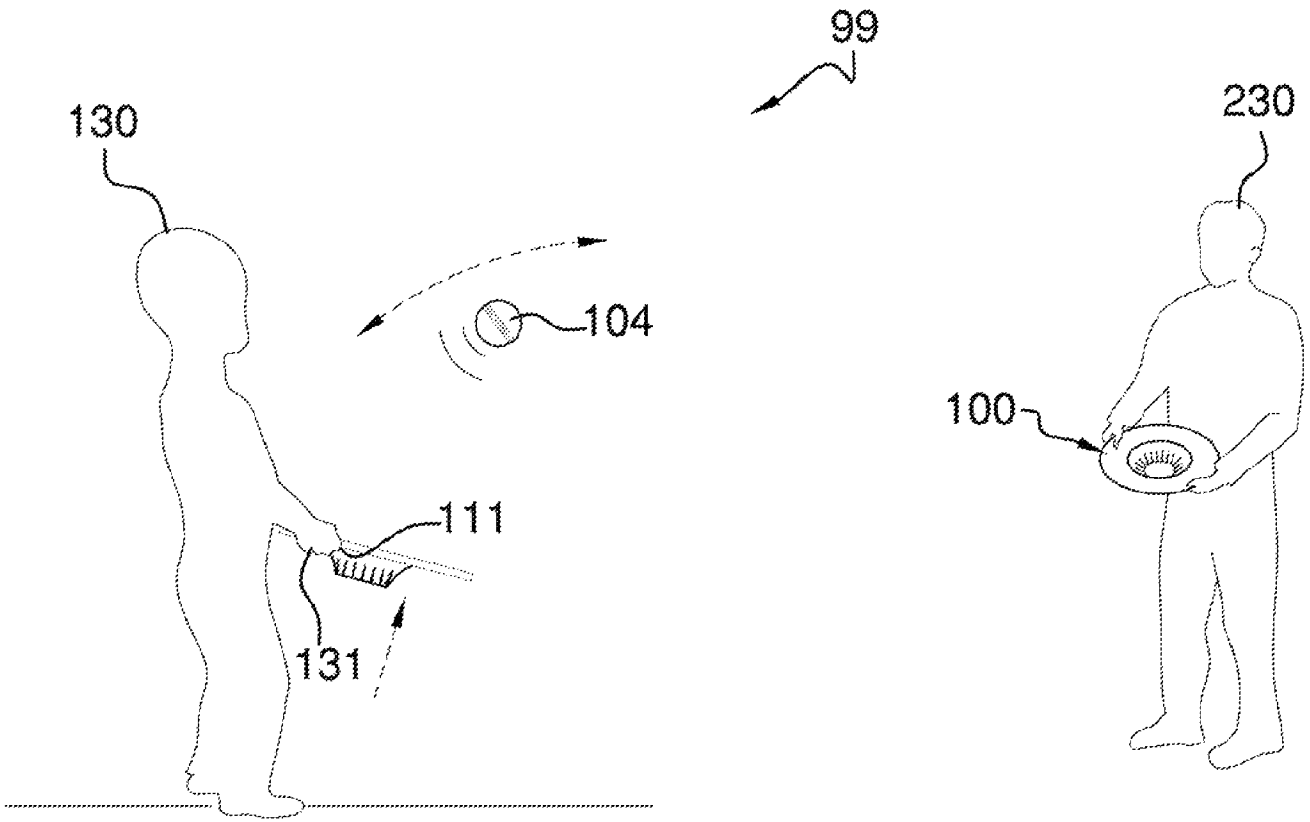
FIG. 5 illustrates a view of the bowl-shaped receptacle in use with a ball and applicable player.

Referring to FIGS. 5-6, the invention 99 is used with the end user 130 and an opposing player 230 to propel the ball 104 back and forth there between. Thus, the end user 130 shall catch and hurl back the ball 104 via a cradling action and consequential hurling motion produced from moving the arms 132 downwardly and then upwardly. Moreover, the use of the invention 99 shall require the end user 130 and the opposing player 230 to catch and hurl back the ball 104 via the cradling action, and to pass through the central opening 151. Over use of force in movement via the end user 120 or opposing player 230 may result in the over flexation of the fingers 150, which may cause the ball 104 to descend through the central opening 151. It is an object of use of the invention 99 to catch the ball 104, and not allow the ball 104 to otherwise fall to the ground. That being so, use of the invention 99 requires some skill in movement of the arms 132 of the end user 130 and the opposing player 230.

With respect to the above description, it is to be realized that the optimum dimensional relationship for the various components of the invention 99, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 99.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A bowl-shaped receptacle comprising:

a bowl-shaped receptacle comprising an annular ring member and bowl appendage attached and descending there from;

wherein a pair of handles are located under said bowl-shaped receptacle, and are grabbed via hands of an end user whom shall partially or fully extend respective arms in concert while aligning, catching, and hurling back a ball via the bowl-shaped receptacle;

wherein the annular ring member is further defined with an inner ring from which the bowl-appendage attaches to and extends downwardly there from;

wherein the bowl appendage is further defined as a concave ring that extends inwardly and downwardly there from and to which forms a central opening; wherein the concave ring is constructed of a flexible material that enables the bowl appendage to trap said ball therein;

wherein the concave ring attaches at the inner ring of the annular ring member, and from which the concave ring extends downwardly to form a plurality of fingers that define the central opening wherein the annular ring member is further defined by a to surface and a bottom surface; wherein the concave ring is further defined with an inner surface and wherein the concave ring includes a grooved lip along a top periphery, which attaches to a contoured notch provided at the inner ring of the annular ring member.

2. The bowl-shaped receptacle and as described in claim 1 wherein the handles are grooves that are integrated into the bottom surface of the annular ring member; wherein the handles and the bottom surface form a lipped edge there under.

3. The bowl-shaped receptacle as described in claim 2 wherein the handles are diametrically opposed from one another.

4. A bowl-shaped receptacle comprising:

a bowl-shaped receptacle comprising an annular ring member and bowl appendage attached and descending there from;

wherein a pair of handles are located under said bowl-shaped receptacle, and are grabbed via hands of an end user whom shall partially or fully extend respective arms in concert while aligning, catching, and hurling back a ball via the bowl-shaped receptacle to an opposing player;

wherein both arms move in concert and are partially or fully extended, and move downwardly or upwardly to cradle and catch and thereafter hurl back said ball to said opposing player;

wherein the annular ring member is further defined with an inner ring from which the bowl-appendage attaches to and extends downwardly there from;

wherein the bowl appendage is further defined as a concave ring that extends inwardly and downwardly there from and to which forms a central opening; wherein the concave ring is constructed of a flexible material that enables the bowl appendage to trap said ball therein wherein the concave ring attaches at the inner ring of the annular ring member, and from which the concave ring extends downwardly to form a plurality of fingers that define the central opening and wherein the annular ring member is further defined by a top surface and a bottom surface and wherein the concave ring is further defined with an inner surface and wherein the concave ring includes a grooved lip along a to periphery, which attach to a contoured notch provided at the inner ring of the annular ring member.

5. The bowl-shaped receptacle as described in claim 4 wherein the handles are grooves that are integrated into the bottom surface of the annular ring member; wherein the handles and the bottom surface form a lipped edge there under.

6. The bowl-shaped receptacle as described in claim 5 wherein the handles are diametrically opposed from one another.

7. A bowl-shaped receptacle comprising:

a bowl-shaped receptacle comprising an annular ring member and bowl appendage attached and descending there from;

wherein a pair of handles are located under said bowl-shaped receptacle, and are grabbed via hands of an end user whom shall partially or fully extend respective arms in concert while aligning, catching, and hurling back a ball via the bowl-shaped receptacle to an opposing player;

wherein both arms move in concert and are partially or fully extended, and move downwardly or upwardly to cradle and catch and thereafter hurl back said ball to said opposing player; wherein the annular ring member is further defined with an inner ring from which the bowl-appendage attaches to and extends downwardly there from;

wherein the bowl appendage is further defined as a concave ring that extends inwardly and downwardly there from and to which forms a central opening; wherein the concave ring is constructed of a flexible material that enables the bowl appendage to trap said ball therein;

wherein the annular ring member is further defined by a top surface and a bottom surface; wherein the concave ring is further defined with an inner surface wherein the concave ring includes a grooved lip along a to periphery, which attach to a contoured notch provided at the inner ring of the annular ring member; wherein the handles are grooves that are integrated into the bottom surface of the annular ring member; wherein the handles and the bottom surface form a lipped edge there under; wherein the handles are diametrically opposed from one another.

* * * * *